United States Patent [19]

Galow et al.

[11] 4,264,415

[45] Apr. 28, 1981

[54] APPARATUS FOR THE DRY COOLING OF COKE

[75] Inventors: Manfred Galow; Horst G. Joseph, both of Essen; Joachim F. Meckel, Heiligenhaus; Rolf Siethoff, Essen, all of Fed. Rep. of Germany

[73] Assignee: Didier Engineering GmbH., Fed. Rep. of Germany

[21] Appl. No.: 106,941

[22] Filed: Dec. 26, 1979

[30] Foreign Application Priority Data

Dec. 27, 1978 [DE] Fed. Rep. of Germany ..... 2856141

[51] Int. Cl.[3] ..... C01B 39/02; C01B 39/12

[52] U.S. Cl. ..... 202/228; 34/174; 201/39

[58] Field of Search ..... 202/227, 228, 95; 201/39; 34/13, 20, 168, 174, 178

[56] References Cited

U.S. PATENT DOCUMENTS

| | | | |
|---|---|---|---|
| 1,690,934 | 11/1928 | Hubmann | 202/228 X |
| 3,721,017 | 3/1973 | Niems | 34/168 X |
| 3,848,344 | 11/1974 | Kemmetmueller | 202/228 X |
| 3,875,683 | 4/1975 | Waters | 34/174 |
| 3,959,084 | 5/1976 | Price | 202/228 X |

FOREIGN PATENT DOCUMENTS

| | | | |
|---|---|---|---|
| 208557 | 8/1924 | United Kingdom | 202/227 |

*Primary Examiner*—Bradley Garris

*Attorney, Agent, or Firm*—Wood, Herron & Evans

[57] ABSTRACT

An apparatus for the dry cooling of coke is disclosed including a vertical cooling chamber having an open bottom, a gas distribution manifold disposed in the bottom of the cooling chamber and a pair of discharge openings for the continuous withdrawal of the cooled coke from the bottom of the chamber. The cooling gas manifold includes upwardly sloping walls which intersect at an apex located generally centrally of the bottom of the cooling chamber. Gas discharge openings extend through these walls and are so disposed as to make cooling gas available across the entire cross-section of the cooling chamber. Individual, closed gas chambers communicate with groups of the gas discharge openings and the flow of gas to each chamber is individually regulated. Temperature sensing means is provided in the cooling chamber and the flow of cooling gas to the individual gas chambers is controlled in response to the temperatures sensed in the cooling chamber to achieve an even cooling distribution throughout the cooling chamber.

10 Claims, 2 Drawing Figures

APPARATUS FOR THE DRY COOLING OF COKE

BACKGROUND OF THE INVENTION

This invention relates to apparatus for the dry cooling of coke and, more particularly, to an apparatus for the dry cooling of coke wherein a cooling gas is routed through a distributor in the bottom of a vertical cooling chamber and wherein the cooled coke is continuously withdrawn through the bottom of the chamber.

In the production of coke from coal, the coal is heated to elevated temperatures in the absence of air in a battery of coke ovens. On completion of the coking operation, the red hot coke is removed from the coke ovens and must be quickly cooled to prevent its burning when exposed to the oxygen in the atmosphere. One method of cooling the red hot coke is to quench the coke with a water spray. Another method, a dry method, involves the quenching of the coke by passing a cooling gas therethrough. One apparatus for the dry cooling of coke is described in German Pat. No. 1,173,870. The cooling chamber of this device is sized for receiving approximately four to six coke oven charges. The cooling chamber is subdivided into several cells and the bottom of each cell is provided with discharge openings through which the cooling gas passes upwardly through the coke contained in the cells. A separate gas supply is provided to each cell enabling the individual control of cooling gas to the cells. This permits uniform cooling of the coke across the cross-section of the cooling chamber.

The subdivision of the cooling chamber into several individual cells to achieve a uniform distribution of the cooling gas and cooling of the coke represents a considerable structural expense primarily because of the need for the partitions in the cooling chamber. In addition, the individual cells require separate openings for each cell to remove the cooled coke. This creates a considerable cross-sectional area across the bottom of the chamber and/or cells through which cooling gas cannot be admitted from below.

SUMMARY OF THE INVENTION

It is among the principal objects of this invention to provide an apparatus for the dry cooling of coke wherein the distribution of gas across the cross-section of the coke cooling chamber may be regulated in response to the heat transfer occurring in different zones of the cooling chamber to achieve more uniform cooling of the coke in the chamber.

To this end, the present invention provides an apparatus for the dry cooling of coke having a vertical cooling chamber with an open bottom, a cooling gas distribution manifold disposed in the open bottom of the cooling chamber and continuous coke withdrawal openings along the peripheral edges of the cooling chamber bottom on either side of the gas distribution manifold. The manifold includes upwardly sloping top walls which intersect at an apex located generally in the center of the bottom of the cooling chamber. The top walls have gas distribution openings extending therethrough. Below the top walls are a plurality of individual gas chambers, each of which has an individually controlled flow of cooling gas thereto. The individual chambers communicate with groups of the gas discharge openings whereby the flow of gas through any given group of openings is dependent on the flow of gas into the chamber in communication therewith. The gas discharge openings are distributed over the entire cross-section of the chamber. Thus, by controlling the flow of gas to the chambers, the flow of gas through the discharge openings may likewise be controlled.

In a presently preferred form of the invention, temperature sensing means are provided in the walls of the cooling chamber as well as in an area in the bottom of the cooling chamber near the apex of the top walls of the gas distribution manifold. The flow of cooling gas is controlled in response to the temperature sensed in the various zones of the cooling chamber. The cooled coke is withdrawn from the cooling chamber in a continuous fashion, the top walls of the gas distribution manifold providing an underlying surface down which the cooled coke slides to intermediate cooling bunkers.

In accordance with the principles of this invention, when the cooling chambers are filled with red hot coke, there occur concentrations of coarsely-granular coke through which the upwardly flowing cooling gas passes relatively easily in chimney-like fashion. This is detrimental to a uniform heat transfer within the more finely granulated coke zones contained between the coarse coke zones because the cooling gas preferentially flows through the zones of coarse-grained coke rather than the zones of fine-grained coke. The present invention overcomes this problem by providing a coke cooling apparatus wherein the flow of cooling gas through the discharge openings located below the coarse-grained coke zone may be reduced and the flow of gas through the discharge openings lying below the zones of more finely granulated coke may be increased. Consequently, a greater volume of cooling gas will pass through the more fine-grained coke zones. The regulation of distribution of the cooling gas also takes place close to the open bottom withdrawal openings of the coke cooling chambers so that the coke being withdrawn, be it coarse or fine-grained, will be uniformly cooled. This in turn permits a more rapid removal of the coke from the cooling chamber because the distribution of the cooling gas has created the desired heat exchange between the cooling gas and coke for all zones in the cooling chamber. Because the gas discharge openings are distributed across the entire cross-section of the chamber, there remain, unlike the prior art, practically no zones of coke in the cooling chamber through which no cooling gas passes. Moreover, as the coke is withdrawn from the cooling chamber, the coke slides down the sloping top walls of the gas distribution manifold and is thereby deflected to one or the other of the coke withdrawal openings. During this passage from the cooling chamber to the intermediate cooling bunkers, the coke is continuously exposed to a flow of cooling gas.

In accordance with a presently preferred form of the invention, the coke withdrawal openings are provided along the long sides of the cooling chamber. The top walls of the gas distribution manifold extend along the long direction of the cooling chamber to form what appears to be a gable-type roof above the individual gas chambers. Preferably, the coke is withdrawn alternately through the side openings and conveyed to intermediate cooling bunkers whereby a continuous withdrawal of coke from the cooling chamber is accomplished.

DETAILED DESCRIPTION OF THE INVENTION

Figure 1:
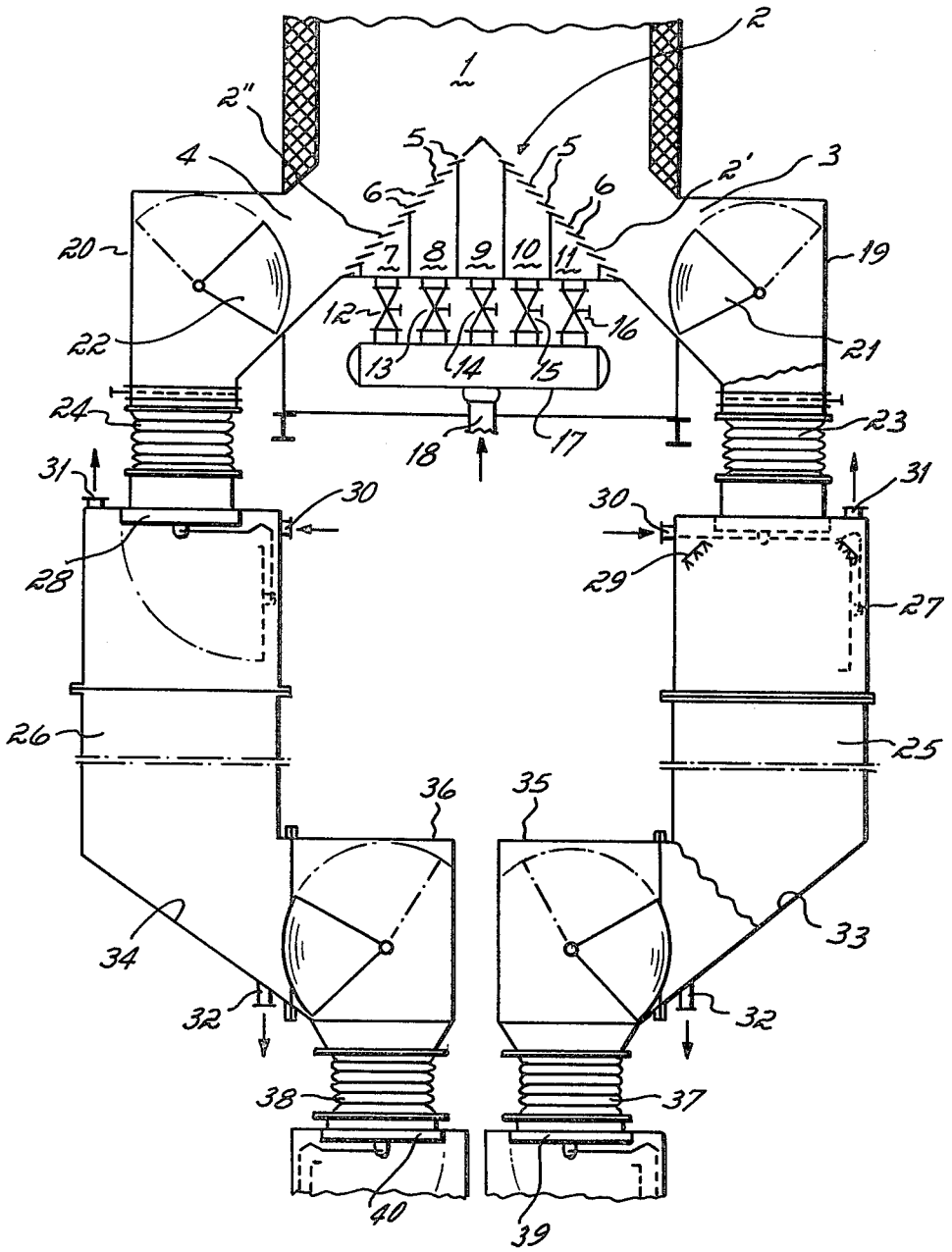
FIG. 1 is a cross-sectional view of an apparatus for the dry cooling of coke in accordance with this invention.

Referring to FIG. 1, the coking cooling apparatus includes a cooling chamber 1 having a gas distribution manifold 2 consisting of two upwardly sloping top walls 2' and 2" which are located symmetrically in the chamber and extend over its entire length. The inclination of the top walls 2' and 2" is so dimensioned that coke contained in the cooling chamber 1 can slide to the withdrawal openings 3 and 4 located along the sides of the bottom of the cooling chamber.

The sloping top walls 2' and 2" are shingle-type, i.e., they are constructed of a number of slats extending along the length of the cooling chamber in overlapping fashion but separated one from another in a vertical direction to provide gas discharge openings 6 in the form of slats 5 and extending along the longitudinal axis of the chamber. These gas discharge openings are distributed over the entire cross section of the cooling chamber 1. Several of the gas discharge openings 6 are connected as a group with gas chambers 7, 8, 9, 10 and 11. Each chamber connects by way of a gas flow control valve 12, 13, 14, 15 and 16 with a gas distributor 17 into which a feed line 18 of cooling gas enters. The gas chambers 7–11 may extend along the entire length of the cooling chamber 1. Viewed in the longitudinal direction of the chamber, however, additional groups of chambers may also be provided with appropriate control valves.

Located at the withdrawal openings 3 and 4 are coke withdrawal control devices 19 and 20 which employ cell type dampers 21 and 22. The coke withdrawal devices 19 and 20 are connected by thermal expansion compensators 23 and 24 to intermediate bunkers 25 and 26, respectively. The intermediate bunkers 25 and 26 are provided with gastight upper caps 27 and 28. Located in the intermediate bunkers is a nozzle system 29, which in FIG. 1 is illustrated only for the intermediate bunker 25, through which water can be fed by way of a water connection 30, providing a water after-quench of the coke. In addition, a vapor exhaust 31 and a water drain 32 are provided on the intermediate bunkers 25 and 26 for the after-quenching.

The intermediate bunkers 25 and 26 include at the bottom sloping walls 33 and 34 having an inclination angle such that coke from the intermediate bunkers 25 and 26 will slide to further withdrawal devices 35 and 36. These are designed the same as the withdrawal devices 19 and 20. Connected to the withdrawal devices 35 and 36 by means of thermal compensators 37 and 38 are gastight caps 39 and 40. These form the bottom seals of the intermediate bunkers 25 and 26. A common coke conveying device is located below the caps 39 and 40 (not illustrated in detail in FIGS. 1 and 2).

The operation of the dry coking cooling apparatus is as follows. Cooling gas is passed into the cooling chamber 1 filled with coke through line 18, the gas distributor 17, control valves 12–16, the gas chambers 7–11, and the gas discharge openings 6 and flows upwardly through the bed of hot coke in the chamber 1. Heat exchange occurs between the hot coke and the gas with the gas absorbing the heat of the coke to cool it. The hot gas is exhausted at the top from the cooling chamber 1. It can then be routed to a device for preheating of the coal to the coking ovens, if desired. The gas flow from the gas discharge openings 6 above the gas chambers 7–11 is controlled by the setting of control valves 12–16. The setting is such that the coke will be cooled uniformly, irrespective of its granulate makeup.

As soon as coke has been cooled by the cooling gas to a temperature in the range of about 450° C. to 350° C., one of the coke withdrawal devices 19 or 20 and the respective cap 27 or 28 is opened (see FIG. 1). The precooled coke will then accumulate in the respective intermediate bunker 25 or 26. Upon closing of the caps 27 or 28 and of the respective coke withdrawal device 19 or 20, a brief wet after-quenching takes place in the bunker whereby the coke is cooled, e.g., below 200° C. The steam created thereby is withdrawn through the steam exhaust 31 and can be routed, after purification, to the coal preheating device.

Upon completion of the after-cooling, the coke is passed by means of the further coke withdrawal devices 35 and 36, and upon opening of the caps 39 or 40, to the coke conveying device.

As long as one of the intermediate bunkers 25 or 26 is filled, dry-cooled coke is routed by means of the coke withdrawal device 20 or 19 into the other intermediate bunker 26 or 25, thereby ensuring a practically continuous coke withdrawal from the cooling chamber 1. Since one of the intermediate bunkers 25 or 26 is always filled, the coke conveying device can be continuously loaded by means of the coke withdrawal device 35 or 36, thereby enabling a continuous operation both with respect to the cooling chamber discharge and the coke conveying device. At the same time, the heat exchange between the hot coke and the cooling gas proceeds uniformly so that also the cooling gas heated by the coke can be routed continuously to the coal preheating device.

The coke withdrawal device 19 and 20 and the caps 27 and 28 can be so controlled via a control device that the intermediate bunkers 25 and 26 are charged as soon as the necessary cooling temperature has been reached in the area of the openings 3 and 4. The control device likewise controls the operation of the withdrawal devices 35 and 36 as well as the bottom caps 39 and 40.

The forced distribution of the cooling gas by means of control valves 12–16 and the alternating but continuous withdrawal of the coke from the cooling chamber results in an overall increase in the rate of coke cooling and withdrawal.

Figure 2:
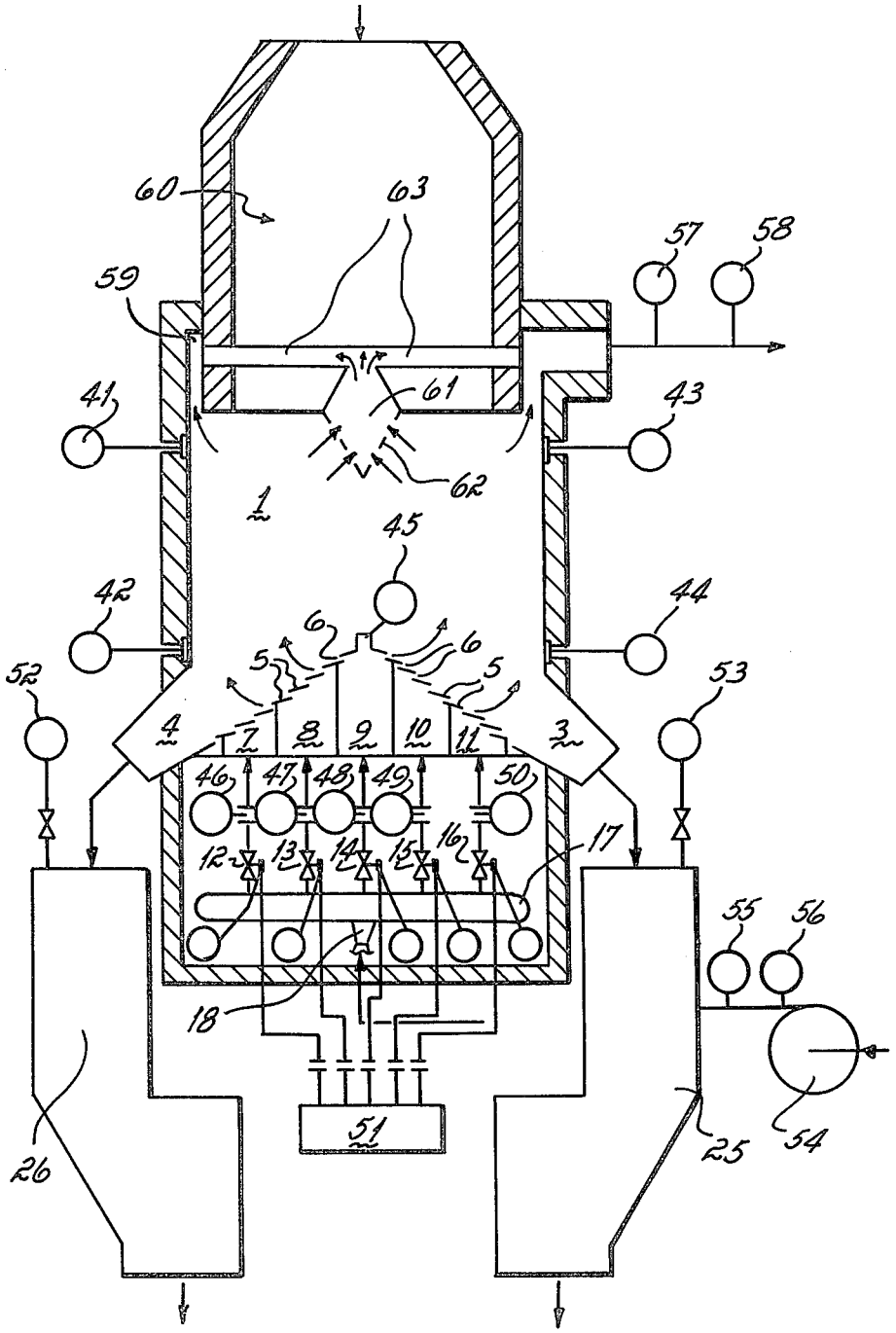
FIG. 2 is a view of the apparatus of FIG. 1 illustrating the location of the temperature measuring apparatus and the construction of the cooling gas exhaust.

Temperature sensors 41–45, located as shown in FIG. 2, are provided in the cooling chamber 1 for determination of the temperatures within representative coke zones. The temperature sensors 41, 42, 43, 44 are located on the walls of cooling chamber 1. The temperature sensor 45 is arranged in the area of the apex formed by the intersection of inclined top walls 2' and 2". Flow meters 46–50 are provided between each of the control valves 12–16 and the respective gas chambers 7–11. Control valves 12–16 can be remote-controlled from a panel 51 whereby the measured values of temperature sensors and gas flow meters 41–50 are indicated.

The temperatures within the intermediate bunkers 25 and 26 are also determined by means of temperature sensors 52 and 53 and transmitted as well to the panel 51. Measuring members 55 and 56 are provided to determine the temperature and pressure of the cooling gas fed by means of a blower 54 to the gas distributor 17. The pressure and temperature of the cooling gas after discharge from the cooling chamber 1 are determined as well by measuring members 57 and 58. These measured values, too, are transmitted to the panel 51.

With the aid of the respective measured values, the control valves 12–16 can be so adjusted that the coke in the cooling chamber 1, especially in zones close to the gas distribution manifold 2 and the withdrawal devices 19 and 20 will be cooled uniformly, irrespective of whether it is coarse or fine-grained. Specifically, high temperatures in the area of the temperature sensors 41–45 indicate that the control valve(s) whose gas flow is admitted to these zones must be opened further. A particularly high volume of flow at one of the flow meter devices 46–50, in conjunction with a low temperature in the respective coke zone, indicates that the respective control valve should be closed down appropriately.

Experience shows that cooling gas will rise generally faster along the side of the cooling chamber. To avoid this, the control valves 12 and 16 of the gas chambers 7 and 11 can be closed to an appropriate degree. Moreover, a center gas withdrawal device 60 is provided on the cooling chamber, in addition to an annular gas withdrawal channel 59 which contributes to a gas withdrawal which is uniform across the chamber cross-section and, thus, also to a uniform coke cooling. The gas withdrawal device 60 is arranged in the center of the cooling chamber 1 and includes a collecting space 61 which is closed toward the charging direction of the coke and provides at a V-shaped bottom 62 with several openings through which heated cooling gas can enter the collecting space 61. The collecting space 61 connects with the gas discharge of the cooling chamber by means of channels 63.

Although our invention has been described in terms of certain preferred embodiments, it will be appreciated that other forms may be adopted within the scope of the invention.

We claim:

1. In an apparatus for the cooling of coke including a cooling chamber and at least two discharge openings for the continuous withdrawal of the cooled coke, the improvement comprising a cooling gas manifold disposed in the bottom of said cooling chamber, said manifold comprising a pair of upwardly sloping walls which intersect to define an apex located generally centrally of the bottom of said cooling chamber, each said wall having a plurality of gas discharge openings therethrough distributed over the entire cross-section of said cooling chamber, a plurality of closed gas chambers below said walls, each said chamber communicating with a group of said gas discharge openings, and means for individually regulating the flow of cooling gas to each said gas chamber.

2. The apparatus of claim 1 wherein the walls of the cooling gas manifold extend along the long direction of the cooling chamber.

3. The apparatus of claim 1 wherein the openings for the continuous withdrawal of the cooled coke lie at the peripheral side edges of the chamber bottom.

4. The apparatus of claim 1 wherein the upwardly sloping walls of the gas cooling manifold provide a surface along which the coke contained in said cooling chamber slides to said discharge openings.

5. The apparatus of claim 1 wherein the upwardly sloping walls of the cooling gas manifold are formed of overlapping members with the gas discharge openings located therebetween.

6. The apparatus of claim 5 wherein said gas discharge openings extend along the length of said members forming said walls of said cooling gas manifold.

7. The apparatus of claim 1 further comprising a gas distributor communicating with said means for individually regulating the flow of cooling gas to each said gas chamber.

8. The apparatus of claim 1 further comprising means for alternately withdrawing cooled coke through said discharge openings and intermediate cooling bunkers for receiving the withdrawn coke.

9. The apparatus of claim 1 wherein said means for individually regulating the flow of cooling gas to each said gas chamber comprises a valve associated with each said chamber for controlling the flow of cooling gas thereto and a flow meter in series with each said valve and wherein said apparatus further comprises temperature sensing means disposed within said cooling chamber.

10. The apparatus of claim 9 wherein said temperature sensor means are located on the walls of said cooling chamber and wherein at least one temperature sensor is located near the apex of said walls of said cooling gas manifold.

* * * * *